US011659914B2

(12) United States Patent
Ellis

(10) Patent No.: US 11,659,914 B2
(45) Date of Patent: May 30, 2023

(54) SHAMPOO ROLL

(71) Applicant: LaTresha M. Ellis, Chelsea, AL (US)

(72) Inventor: LaTresha M. Ellis, Chelsea, AL (US)

( * ) Notice: Subject to any disclaimer, the term of this patent is extended or adjusted under 35 U.S.C. 154(b) by 0 days.

(21) Appl. No.: 17/240,325

(22) Filed: Apr. 26, 2021

(65) Prior Publication Data

US 2021/0330059 A1 Oct. 28, 2021

Related U.S. Application Data

(60) Provisional application No. 63/015,578, filed on Apr. 26, 2020.

(51) Int. Cl.
*A45D 44/10* (2006.01)

(52) U.S. Cl.
CPC ..... *A45D 44/10* (2013.01)

(58) Field of Classification Search
CPC ..... A45D 44/10; A47K 3/125; A47K 3/127; A47G 9/109
See application file for complete search history.

(56) References Cited

U.S. PATENT DOCUMENTS

| | | | | | |
|---|---|---|---|---|---|
| 2,167,178 | A * | 7/1939 | Kohlstadt | A47K 3/125 | 4/575.1 |
| 2,351,849 | A * | 6/1944 | Wells | A45D 44/10 | 4/523 |
| 4,195,378 | A * | 4/1980 | Parker | A47K 10/02 | 5/419 |
| 5,548,853 | A * | 8/1996 | Johnson | A45D 19/10 | 4/523 |
| 5,587,219 | A * | 12/1996 | Schofield | B32B 3/08 | 428/68 |
| 9,392,859 | B2 * | 7/2016 | Barman | A45D 19/08 | |
| 2007/0017018 | A1 * | 1/2007 | Jenkins | A45D 19/10 | 4/523 |
| 2021/0315423 | A1 * | 10/2021 | Voltz | A47D 13/08 | |

* cited by examiner

*Primary Examiner* — Janie M Loeppke
(74) *Attorney, Agent, or Firm* — Gearhart Law, LLC; David Postolski

(57) ABSTRACT

A neck cushioning device (or a "shampoo roll") that relieves neck pain of a first user during the washing of the first user's hair and also relieves back pain of a second user who is washing the first user's hair is described herein. The device includes a unitary elongated piece having a first side disposed opposite a second side and a first end disposed opposite a second end and a portion affixed to the first end of the unitary elongated piece. The second side of the neck cushioning device rests on a horizontal surface. A body of the user rests on the first side of the unitary elongated piece, a neck of a user is rested on the portion, and hair of the user is received in a sink.

18 Claims, 11 Drawing Sheets

SHAMPOO ROLL

CROSS-REFERENCE TO RELATED APPLICATIONS SECTION

This application is a U.S. Non-Provisional Patent Application that claims priority to U.S. Provisional Patent Application No. 63/015,578 filed on Apr. 26, 2020, the entire contents of which are hereby incorporated by reference in their entirety.

FIELD OF THE EMBODIMENTS

This invention relates to a neck cushioning device (or a "shampoo roll") that relieves neck pain of a first user during the washing of the first user's hair and also relieves back pain of a second user who is washing the first user's hair.

BACKGROUND OF THE EMBODIMENTS

Professional hair stylists typically utilize a shampoo basin or bowl for shampooing the hair of their patrons. The patron reclines in a chair such that the head of the patron is within the basin with the patrons neck rests against the rim of the basin. Typical basins are made of a hard porcelain or fiberglass, which causes discomfort to the patron's neck when the patron is getting his/her hair shampooed. Similarly, when shampooing the hair of a child, it is necessary to extend the child's head over a basin or a sink when wetting the hair, applying the shampoo, and rinsing the hair.

In either scenario, it is preferable to use some sort of object to alleviate neck pain for the patron or the child. Towels may be used in this situation, but typically provide insufficient comfort and may slip out of place. Moreover, though durable pads may be used, these objects are difficult to clean. Thus, what is needed is an improved device that not only relieves neck pain of a first user during the washing of the first user's hair and also relieves back pain of a second user who is washing the first user's hair.

Review of Related Technology

U.S. Pat. No. 7,707,663B1 describes a shampoo basin cushioning piece that cushions the neck along notch in the shampoo basin, and also securely fastens along the top perimeter of the shampoo basin. The ability of the cushioning device to securely attach along the perimeter of the shampoo basin enables the cushioning device to avoid movement and remain steady when the neck of an end user is placed upon it. The cushioning piece seeks to eliminate the movement and associated neck soreness associated with moving cushions that are designed for the neck notch of a shampoo basin. A sink or porcelain base converter that when placed over the sink or porcelain base will convert it into a shampoo basin.

U.S. Pat. No. 6,925,660B1 describes a cushioning device for use with a shampoo bowl that includes a front wall having an inner surface and an outer surface, and a U-shaped, neck-receiving notch in the front wall. The cushioning device includes a flexible cushion constructed of a matrix of formed cushioning pockets separated by seams. The flexible cushion includes opposing proximal and distal extremities and a waist therebetween. The waist is adapted to overlie a segment of the U-shaped, neck receiving notch, the proximal extremity is adapted to overlie and secure a portion of the inner surface of the front wall, and the distal extremity is adapted to overlie a secure portion of the outer surface of the front wall.

U.S. Pat. No. 5,978,980A describes a neck cushioning device that is adapted for use with a shampoo basin having a neck-receiving notch and includes a cushioning pad formed of a gel-based material. The shape of the cushioning pad is configured in such a way that the neck cushioning device conforms to a variety of different-shaped neck-receiving notches in shampoo basins. The shape of the cushioning pad is symmetrical about two orthogonal axes, with the first of these axes being generally transverse to a person's head and neck. The first dimension of the cushioning pad along the first axis is greater than a second dimension of the cushioning pad along the other of the two axes. The neck cushioning device includes a covering for housing the cushioning pad which is formed of a flexible, water-repellent material. The covering includes a pair of flap portions on opposed sides of the first axis of the cushioning pad. The flap portions include components for releasably securing the neck cushioning device to the shampoo basin.

U.S. Pat. No. 4,763,364A describes a neck cushioning device for engagement with hair shampoo bowls. The cushioning device is comprised of a cushion of resilient material coated with a flexible, water-repellent substance over the entire surface. The cushioning device is adaptable to overlay the U-shaped neck-receiving notch found on a commercial shampoo bowl and to wrap laterally around the edges of the notch for engagement therewith by means of downwardly projecting walls, one of which includes a protruding lip that curls around the notch and secures the cushioning device to the bowl.

Various systems are known in the art. However, their function and means of operation are substantially different from the present invention.

SUMMARY OF THE EMBODIMENTS

The present invention comprises a neck cushioning device (or a "shampoo roll") that relieves neck pain of a first user during the washing of the first user's hair and also relieves back pain of a second user who is washing the first user's hair.

An embodiment of the present invention describes a neck cushioning device to relieve neck pain of a user during washing the user's hair. The neck cushioning device includes a unitary elongated piece and a portion. The unitary elongated piece has a first side disposed opposite a second side and a first end disposed opposite a second end. The portion is affixed to the first end of the unitary elongated piece. The portion may comprise a circular shape, an oval shape, a rectangular shape, a square shape, a triangular shape, a quadrilateral shape, a pentagonal shape, a hexagonal shape, a heptagonal shape, an octagonal shape, a nonagonal shape, a decagonal shape, a tear-drop shape, or a crescent shape, among other shapes not explicitly listed herein. In preferred examples, the portion comprises the tear-drop shape. In other examples, the shape is formed from material folded upon itself.

The second side of the neck cushioning device rests on a horizontal surface. The user is lying flat on the first side of the unitary elongated piece and a neck of a user is rested on the portion. Hair of the user is received in a sink.

In some examples, the neck cushioning device is a one-time use device. In other examples, the neck cushioning device is a reusable device. In scenarios where the neck cushioning device is reusable, the neck cushioning device includes a flexible cushioning material, a gel-based material, a waterproof or water-repellant material, and/or a foam material and may include a removable waterproof cover configured to receive the neck cushioning device therein. In some examples, the unitary elongated piece is affixed to the portion via a fixation means, where the fixation means includes: Velcro, securing ties, loops, snaps, hooks, clasps, adhesives, and/or thread. In other examples, the unitary elongated piece and the portion are configured as a single component.

In some embodiments, the portion comprises an indentation portion configured to receive the neck of the user. In other examples, the neck cushioning device includes a flap component affixed to the portion, where the flap component is received in the sink during use. The portion rolls upon the unitary elongated piece to reduce a length of the unitary elongated piece for storage of the neck cushioning device. The flap component comprises a first set of fixation means configured to interact with a second set of fixation means on the unitary elongated piece to maintain a closed or stored position of the neck cushioning device.

In some examples, the second side of the unitary elongated piece further comprises a handle component used to carry the neck cushioning device when in a closed or stored position. Moreover, in examples, the second side of the unitary elongated piece further comprises a pouch configured to receive one or more objects therein for storage.

In general, the present invention succeeds in conferring the following benefits and objectives.

The present invention provides a neck cushioning device (or a "shampoo roll") that relieves neck pain of a first user during the washing of the first user's hair.

The present invention provides a neck cushioning device that relieves back pain of a second user who is washing the first user's hair.

The present invention provides a single-use neck cushioning device.

The present invention provides a reusable neck cushioning device.

The present invention provides a neck cushioning device that may be used in numerous settings, such as a professional salon setting, a home setting, a rehabilitative setting, a medical/healthcare/hospital/nursing home facility, a school setting, etc.

DESCRIPTION OF THE PREFERRED EMBODIMENTS

Figure 1:
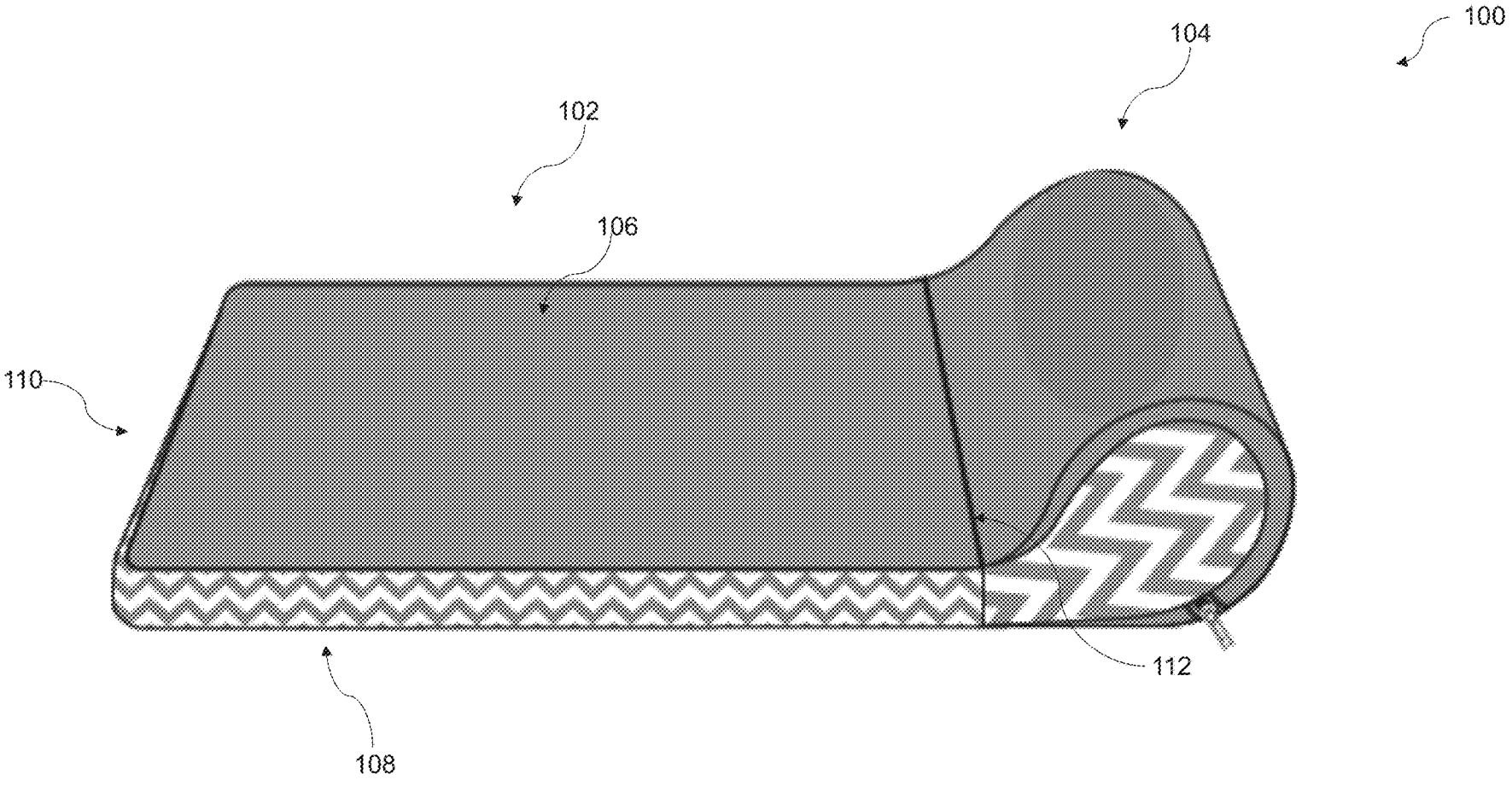
FIG. 1 and FIG. 2 depict perspective views of a neck cushioning device, according to at least some embodiments described herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As described, a need exists for a device that not only relieves neck pain of a first user during the washing of the first user's hair, but also relieves back pain of a second user who is washing the first user's hair. Traditional towels often provide insufficient comfort and may slip out of place. Moreover, durable pads known in the field are difficult to clean. A neck cushioning device 100 of the present invention provides these benefits and is described and depicted herein.

The neck cushioning device 100 of FIG. 1-FIG. 10, may include several components, such as a unitary elongated piece 102 and a portion 104. The unitary elongated piece 102 may have a first side 106 disposed opposite a second side 108 and a first end 112 disposed opposite a second end 110. The portion 104 may be affixed to the first end 112 of the unitary elongated piece 102.

Figure 5:
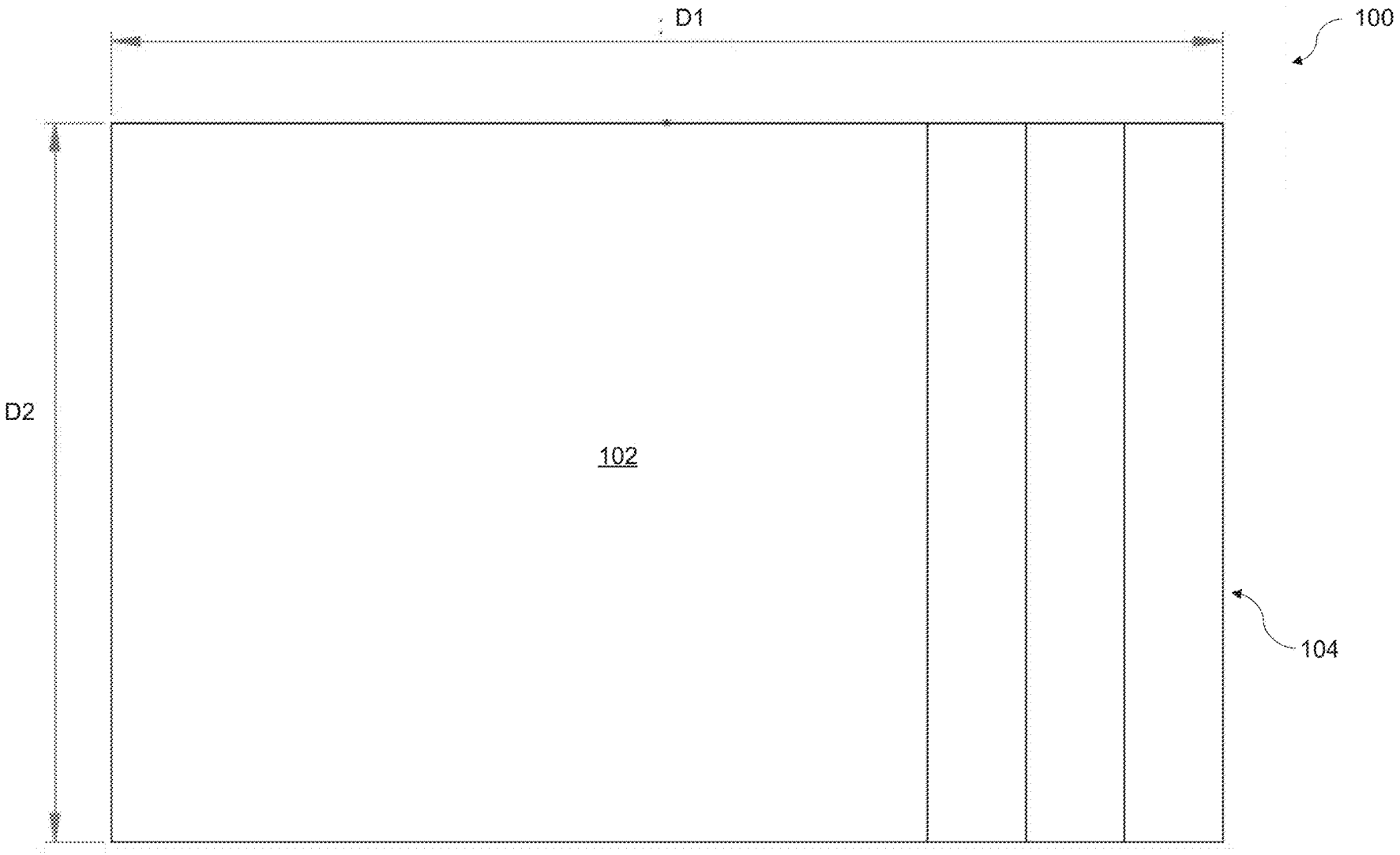
FIG. 5 depicts a perspective view of various dimensions of a neck cushioning device, according to at least some embodiments described herein.
Figure 6:
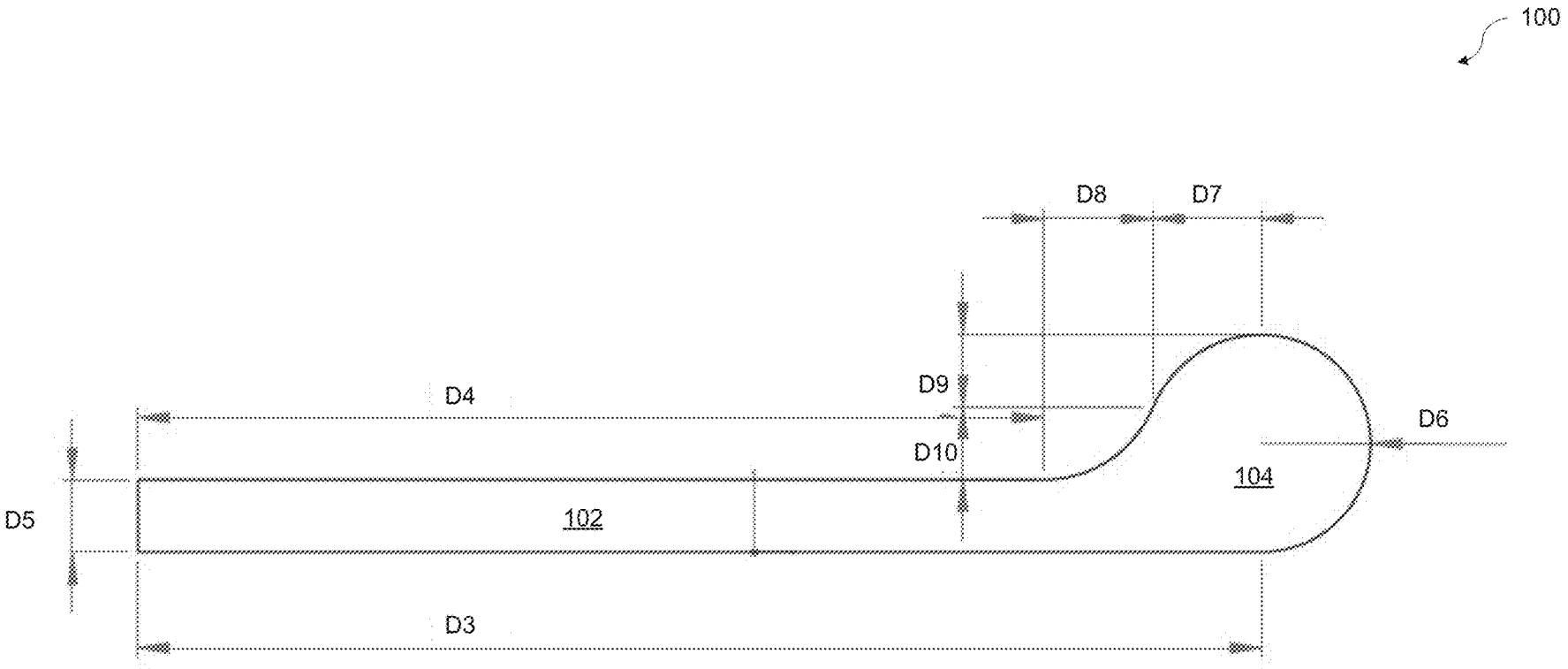
FIG. 6 depicts a side view of various dimensions of a neck cushioning device, according to at least some embodiments described herein.

Various dimensions of the neck cushioning device 100 are depicted in FIG. 5 and FIG. 6 and are listed below in Table 1. It should be appreciated that these dimensions are provided for illustrative purposes only and other dimensions are contemplated herein.

TABLE 1

Dimensions of the Neck Cushioning Device 100

| Reference Number | Dimensional Range (in inches) |
|---|---|
| D1 | 20-30 |
| D2 | 10-20 |
| D3 | 20-30 |
| D4 | 10-20 |
| D5 | 0.1-2.5 |
| D6 | 2-4 |
| D7 | 2-4 |
| D8 | 2-4 |
| D9 | 0.1-2.5 |
| D10 | 0.1-2.5 |

In some examples, a shape of the portion 104 of the neck cushioning device 100 may be: a circular shape, an oval shape, a rectangular shape, a square shape, a triangular shape, a quadrilateral shape, a pentagonal shape, a hexagonal shape, a heptagonal shape, an octagonal shape, a nonagonal shape, a decagonal shape, a tear-drop shape, or a crescent shape, among other shapes not explicitly listed herein. In preferred examples, the shape of the portion 104 of the neck cushioning device 100 is the tear-drop shape. In this preferred example, an apex 114 of the portion 104 is affixed to the first end 112 of the unitary elongated piece 102. In other examples, a shape of the portion 104 may be formed from material folded upon itself.

Figure 2:
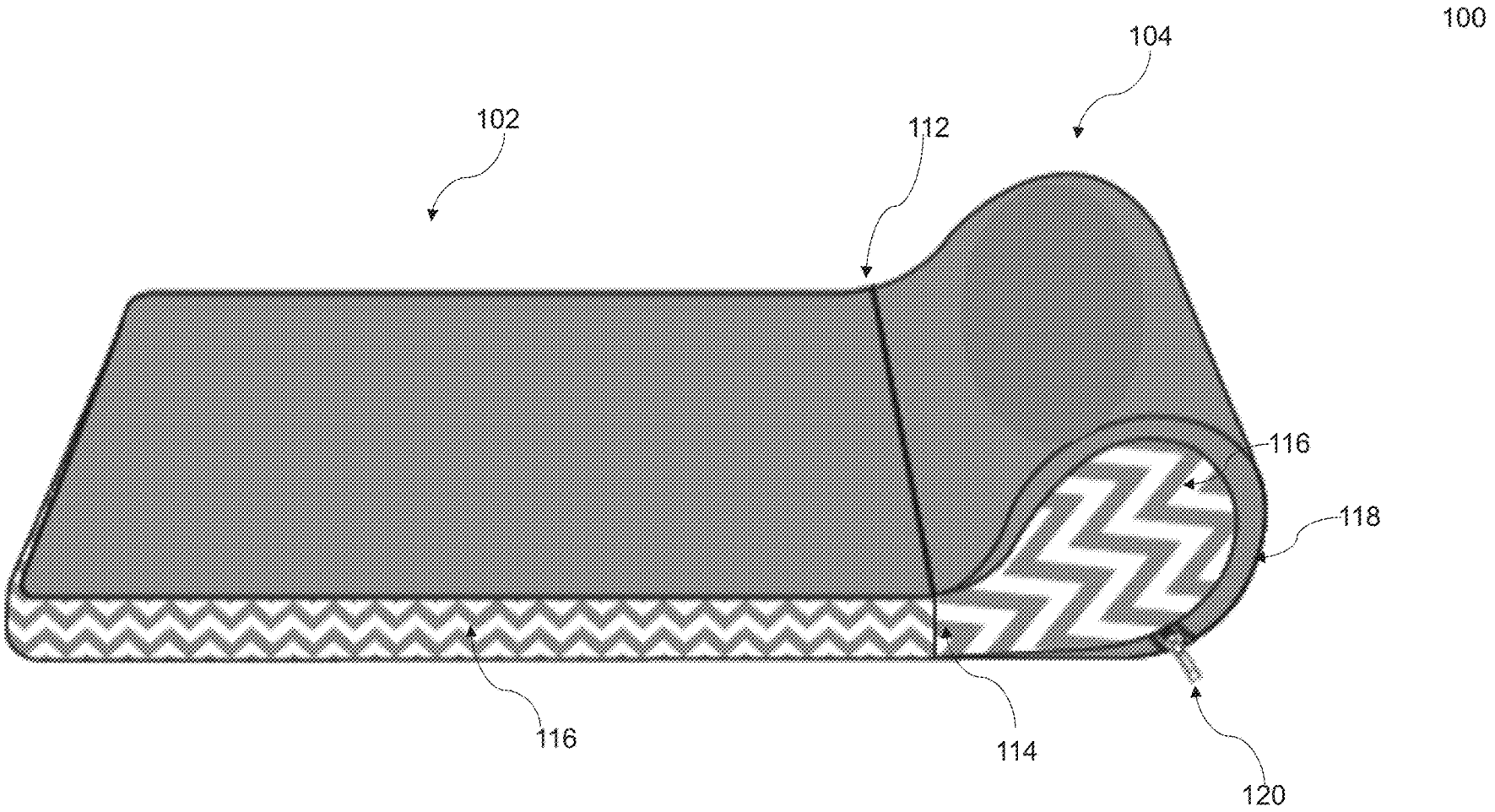

In some examples, the neck cushioning device 100 is a one-time use device for sanitary purposes. In other implementations, the neck cushioning device 100 is a reusable device. In situations where the neck cushioning device 100 is reusable, the neck cushioning device 100 may include a material 116, as shown in FIG. 2. The material 116 may be a flexible cushioning material, a gel-based material, and/or a foam material, among other materials not explicitly listed herein. The foam material may be a memory foam material, among other materials. In some examples, the material 116 may be deformable such that it conforms to the users' neck, ensuring water will not run down the patrons back during the shampoo process. It should further be appreciated that the material 116 may be identical for the unitary elongated piece 102 and the portion 104. In other examples, the material 116 may differ for the unitary elongated piece 102 and the portion 104.

In some examples, the material 116 may include a waterproof or a water-repellent coating. In other implementations, the material 116 may include a non-slip material to prevent movement of the neck cushioning device 100 during use. It should be appreciated that the non-slip material is not limited to any particular materials.

Figure 3:
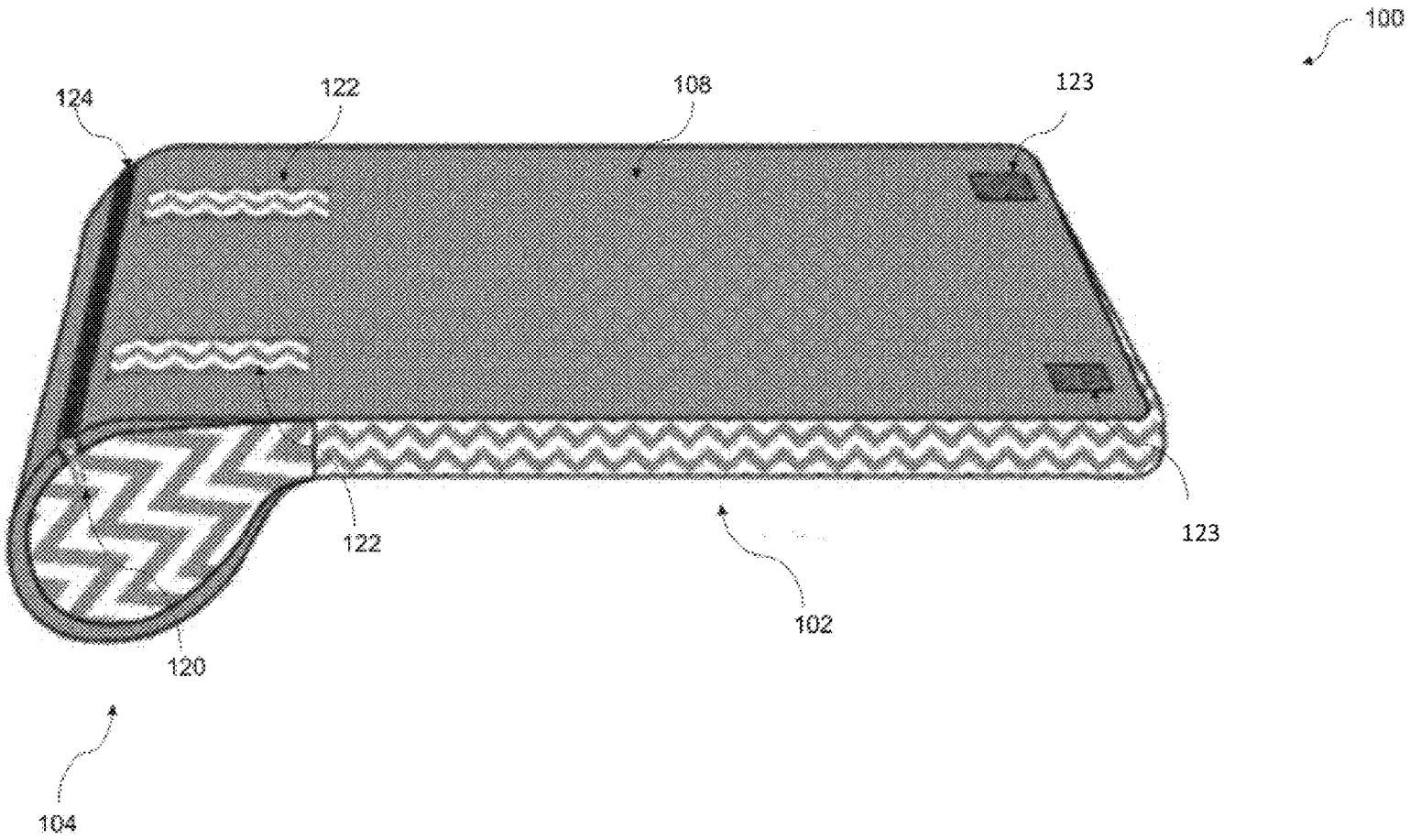
FIG. 3 depicts a bottom view of a neck cushioning device, according to at least some embodiments described herein.
Figure 4:
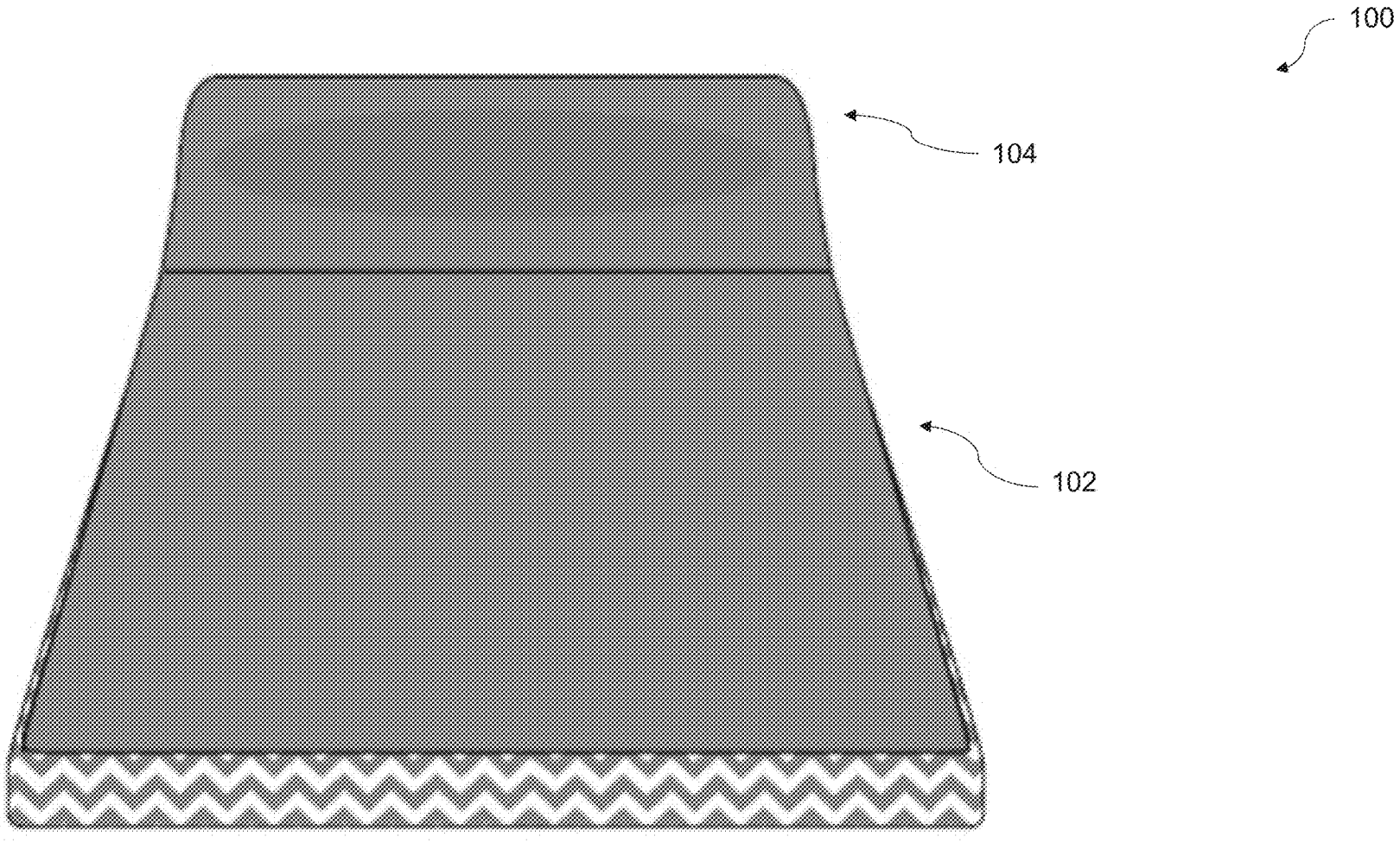
FIG. 4 depicts a perspective view of a neck cushioning device, according to at least some embodiments described herein.

In some examples, the neck cushioning device 100 may also include a removable waterproof cover 118 (of FIG. 2) that is configured to receive the neck cushioning device 100 therein. In some examples, the waterproof cover 118 comprises a polyurethane (PU) leather material. However, it should be appreciated that the waterproof cover 118 is not limited to such material. As shown in FIG. 2 and FIG. 3, a zipper 120 and a teeth chain 124 of the removable waterproof cover 118 may allow the removable waterproof cover 118 to be removed from the neck cushioning device 100. Moreover, as shown in FIG. 2 and FIG. 3, the zipper 120 and the teeth chain 124 of the removable waterproof cover 118 may allow the removable waterproof cover 118 to receive the neck cushioning device 100 therein for affixing the removable waterproof cover 118 to the neck cushioning device 100. The waterproof or a water-repellent coating of the material 116 and the removable waterproof cover 118 ensure that water will not get trapped within the neck cushioning device 100, preventing bacteria from growing.

The unitary elongated piece 102 may be affixed to the portion 104 via one or more fixation means 122 located on the second side 108 of the unitary elongated piece 102, as shown in FIG. 3. The one or more fixation means 122 may include Velcro, securing ties, snaps, hooks, loops, clasps, adhesives, and/or thread, among other fixation means not explicitly listed herein. It should be appreciated that any fixation means may be used. In other examples, the unitary elongated piece 102 and the portion 104 are configured as a single component or a single unit.

Figure 7A:
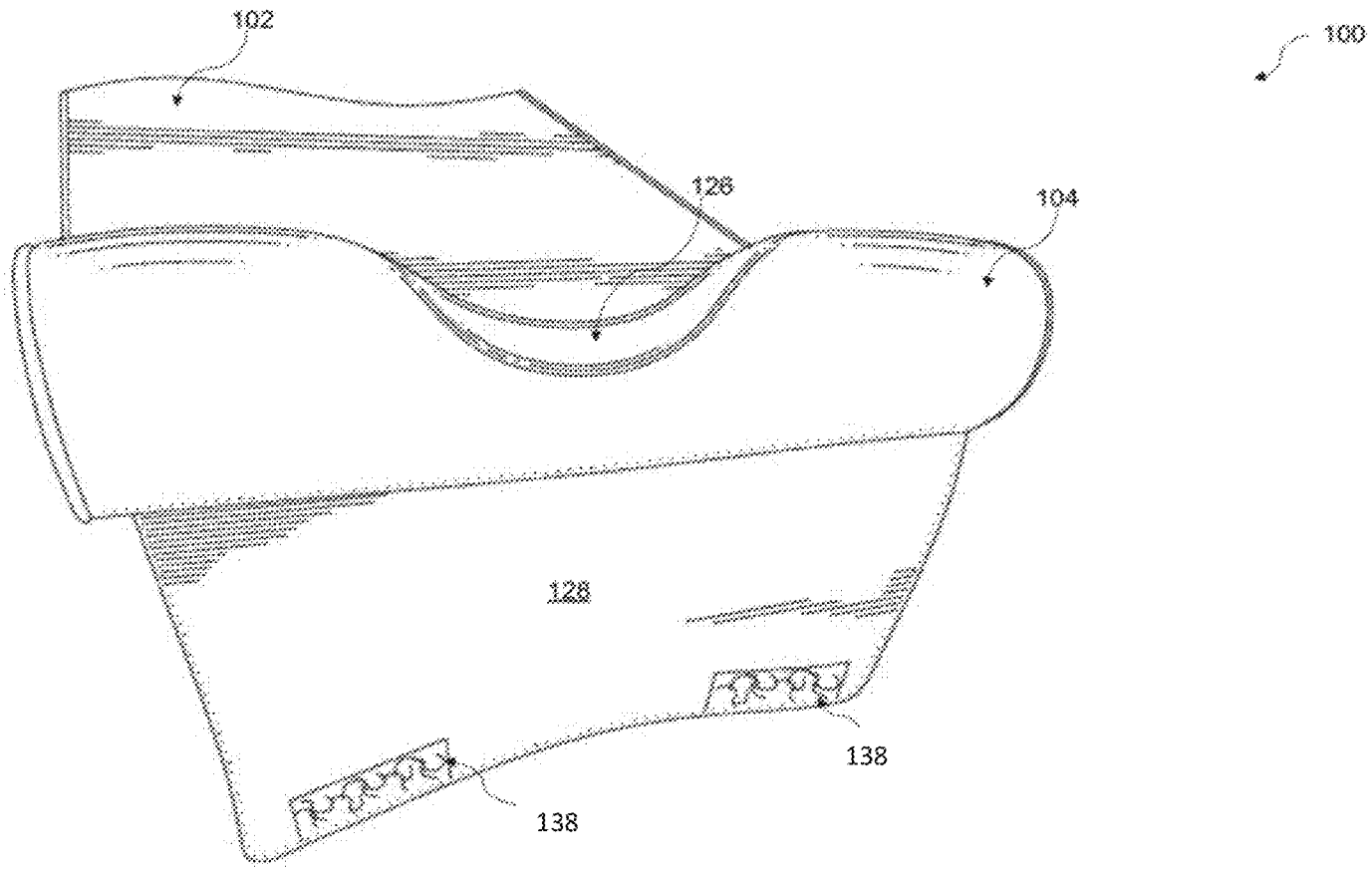
FIG. 7A depicts a perspective view of a neck cushioning device that comprises an indentation portion and a flap component, according to at least some embodiments described herein.
Figure 7B:
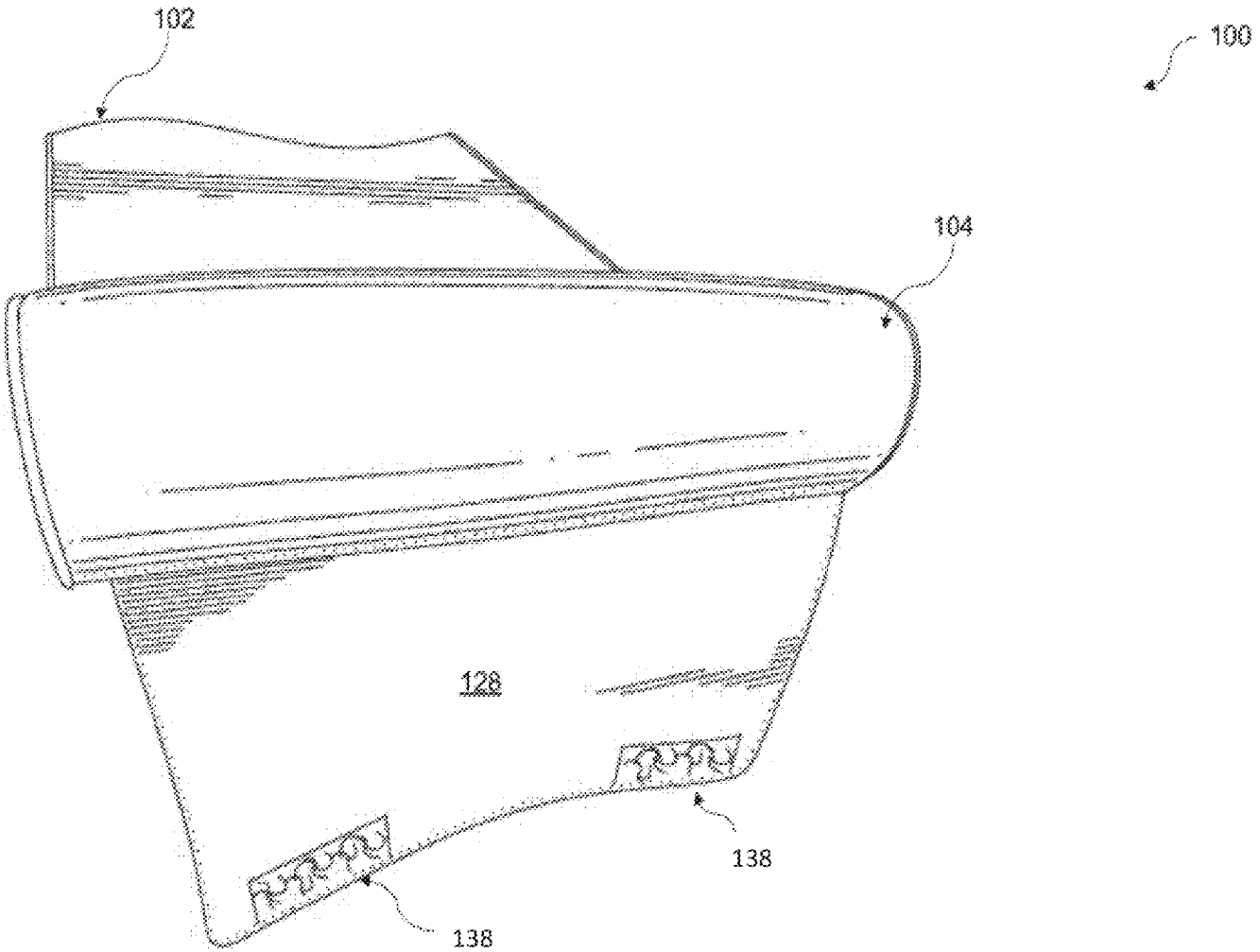
FIG. 7B depicts a perspective view of a neck cushioning device that comprises a flap component, according to at least some embodiments described herein.
Figure 8:
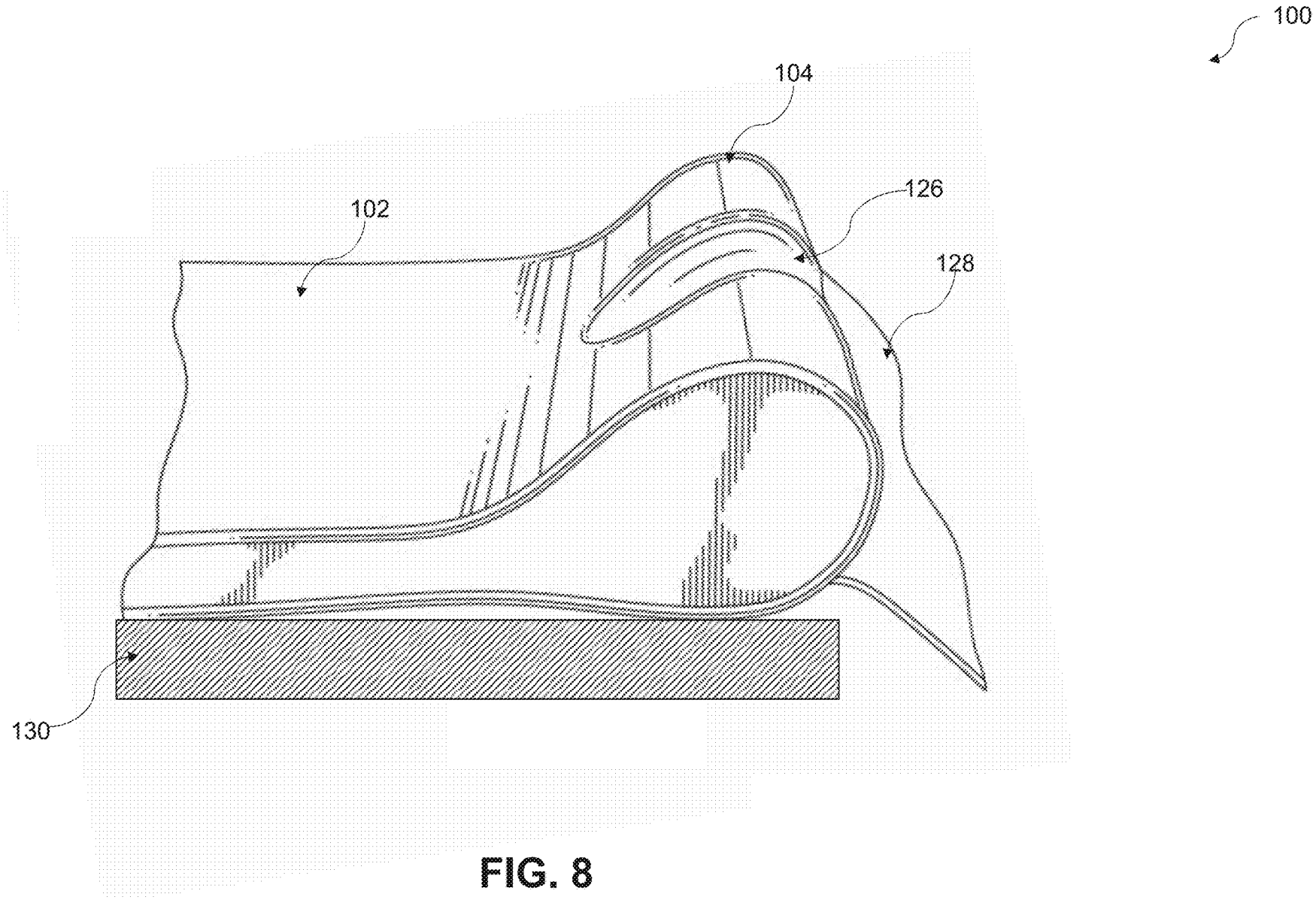
FIG. 8 depicts a perspective view of a neck cushioning device that comprises an indentation portion and a flap component, according to at least some embodiments described herein.

As shown in FIG. 7A and FIG. 8, the portion 104 of the neck cushioning device 100 may include an indentation portion 126 configured to receive a neck of the user therein when the neck cushioning device 100 rests on a horizontal surface 130 (e.g., a countertop) of FIG. 8 and the user is lying flat on the first side 106 of the unitary elongated piece 102. Moreover, as shown in FIG. 7A, FIG. 7B, and FIG. 8, in some embodiments, the neck cushioning device 100 may further include a flap component 128 affixed to the portion 104. The flap component 128 is received in a sink during use. It should be appreciated that in some examples, the flap component 128 is removably affixed to the portion 104. In other examples, the flap component 128, the unitary elongated piece 102, and the portion 104 are configured as a singular unit/component.

In some examples, the second side 108 of the neck cushioning device 100 rests on the horizontal surface 130, such as a countertop. In this example, the user is lying flat on the first side 106 of the unitary elongated piece 102 and a neck of a user rests on the portion 104, such that hair of the user is received in the sink. It should be appreciated that the portion 104 is lifted a distance from the first side 106 of the unitary elongated piece 102, which allows the users head to be lifted, thereby reducing the neck pain of the user getting his/her hair washed.

Moreover, for storage purposes, the portion 104 may be rolled upon the unitary elongated piece 102 to reduce a length of the unitary elongated piece 102, as shown in FIG. 7. As described, this device may be used for children or adults in numerous settings, such as: a professional salon setting, a home setting, a rehabilitative setting, a medical/healthcare/hospital/nursing home facility, a school setting, etc.

In some examples, a first side of the flap component 128 may comprise a first set of fixation means 138 configured to interact with a second set of fixation means (123) on the second side 108 of the unitary elongated piece 102 to establish and maintain a closed or stored position of the neck cushioning device 100. The first set of fixation means 138 and the second set of fixation means 123 may be any fixation means or mechanism known in the art, such as: Velcro, securing ties, snaps, hooks, loops, clasps, adhesives, and/or thread, among other fixation means not explicitly listed herein.

Figure 9:
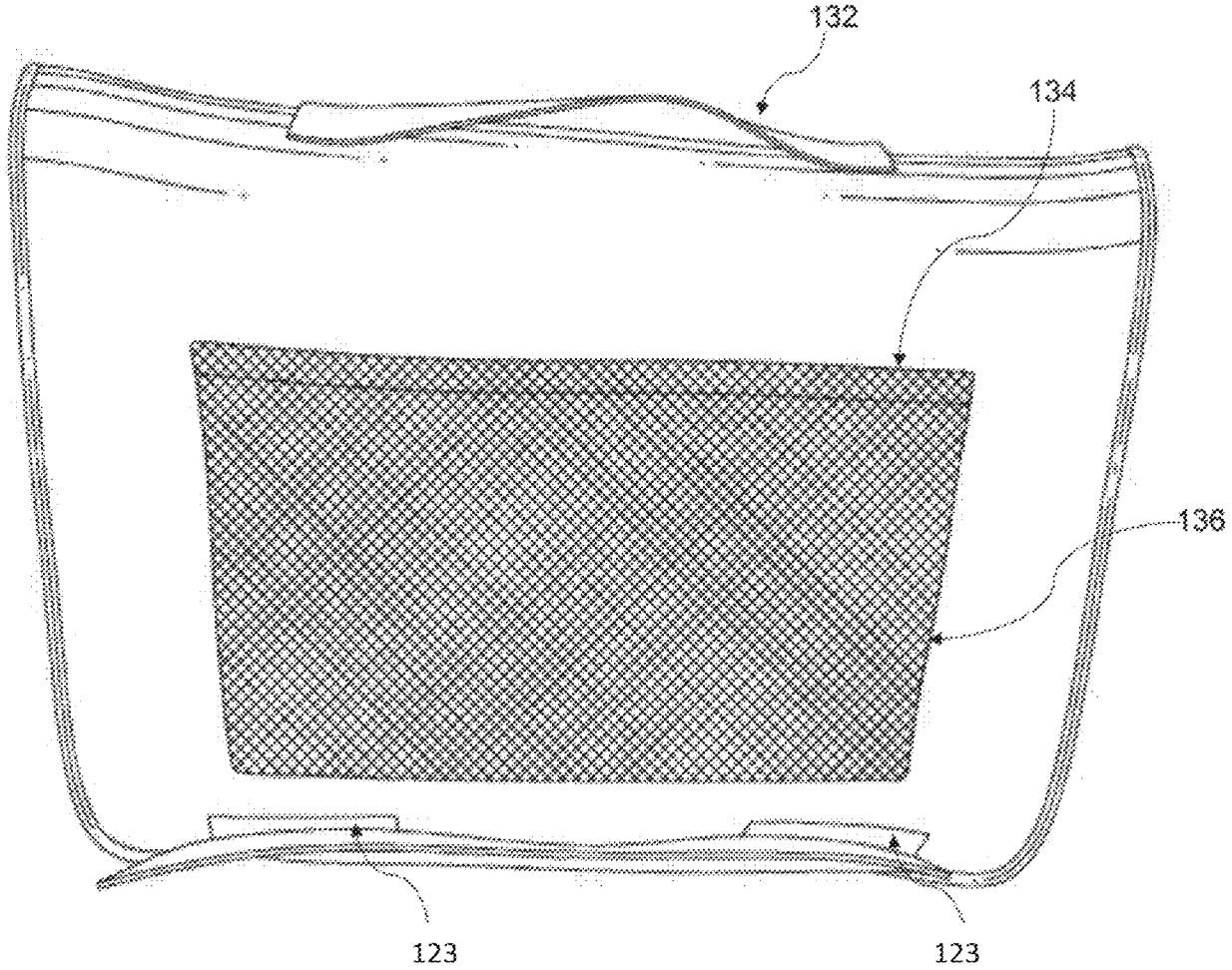
FIG. 9 depicts a perspective view of a stored configuration of a neck cushioning device, where the neck cushioning device comprises a handle component and a pouch component, according to at least some embodiments described herein.
Figure 10:
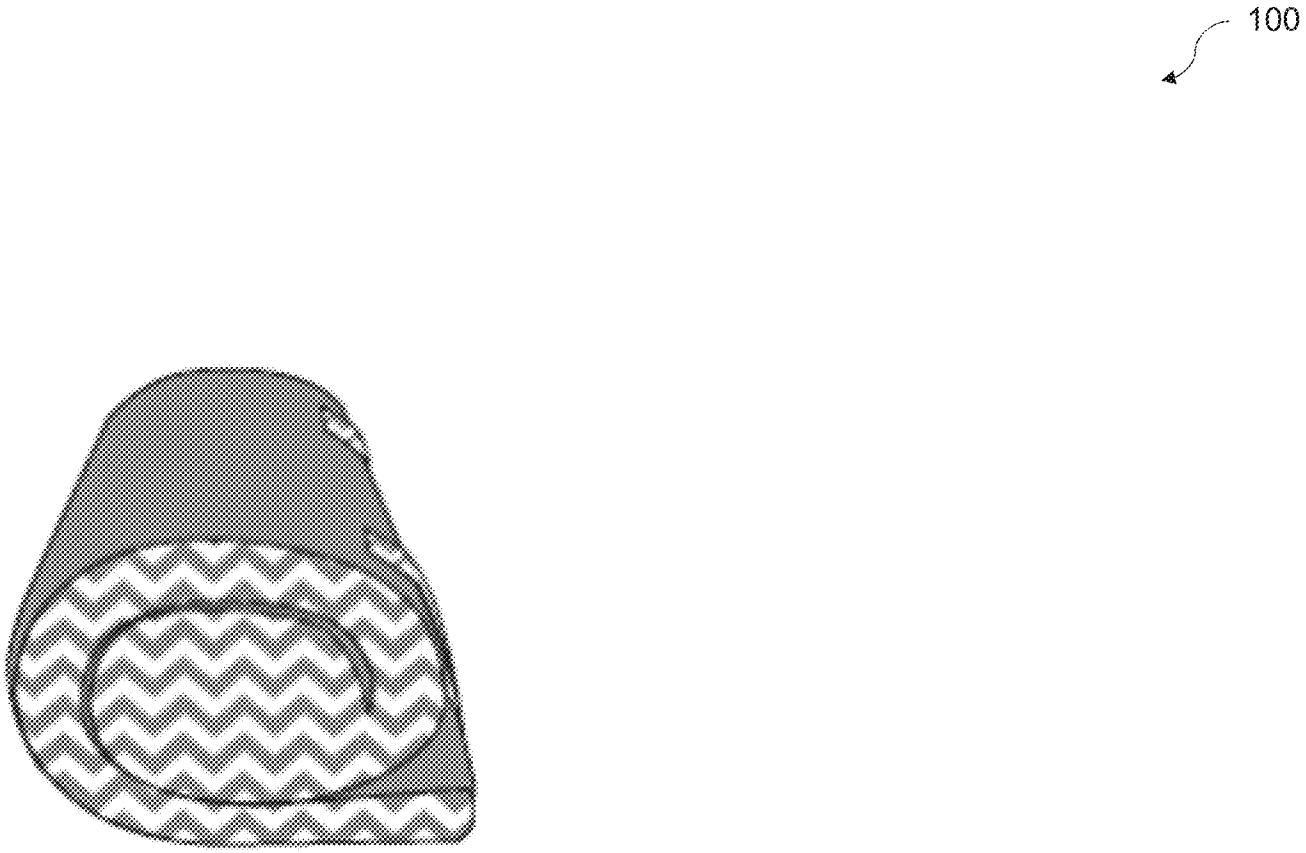
FIG. 10 depicts a perspective view of a stored configuration of a neck cushioning device, according to at least some embodiments described herein.

As shown in FIG. 9, the second side 108 of the unitary elongated piece 102 further comprises a handle component 132 used to carry the neck cushioning device 100 when in a closed or stored position. In some embodiments, and as shown in FIG. 9, the second side 108 of the unitary elongated piece 100 may further include a pouch 136 having an opening 134 configured to receive one or more objects therein for storage when the neck cushioning device 100 is in the closed or stored position.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A neck cushioning device to relieve neck pain of a user during washing the user's hair, the neck cushioning device comprising:

a unitary elongated piece having a first side disposed opposite a second side and a first end disposed opposite a second end;

a portion affixed to the first end of the unitary elongated piece, and a removable waterproof cover configured to receive the entire neck cushioning device therein and to affix the cover to and enclose the neck cushioning device using a zipper and teeth chain;

a flap component affixed to the portion, wherein the flap component is received in the sink during use;

wherein the second side of the neck cushioning device rests on a horizontal surface, wherein the first side of the unitary elongated piece is configured to receive a body of the user, wherein the portion is configured to receive a neck of the user, wherein a sink is configured to receive the hair of the user, wherein the flap component comprises a first set of fasteners configured to interact with a second set of fasteners located on the second side of the unitary elongated piece to maintain a closed configuration of the neck cushioning device.

2. The neck cushioning device of claim 1, wherein the neck cushioning device is a one-time use device.

3. The neck cushioning device of claim 1, wherein the neck cushioning device is a reusable device.

4. The neck cushioning device of claim 3, wherein the neck cushioning device comprises a material selected from the group consisting of: a flexible cushioning material, a gel-based material, and a foam material.

5. The neck cushioning device of claim 4, wherein the material comprises a waterproof coating.

6. The neck cushioning device of claim 1, wherein the unitary elongated piece is affixed to the portion via the first and second set of fasteners located on the second side of the unitary elongated piece.

7. The neck cushioning device of claim 6, wherein the first and second set of fasteners is selected from the group consisting of: hook and loop fasters, securing ties, loops, snaps, hooks, clasps, adhesives, and thread.

8. The neck cushioning device of claim 1, wherein the unitary elongated piece and the portion are configured as a single component.

9. The neck cushioning device of claim 1, wherein the portion comprises an indentation portion configured to receive the neck of the user.

10. The neck cushioning device of claim 1, wherein the second side of the unitary elongated piece further comprises a handle component used to carry the neck cushioning device when in a closed or stored position.

11. The neck cushioning device of claim 1, wherein the second side of the unitary elongated piece further comprises a pouch configured to receive one or more objects therein for storage.

12. The neck cushioning device of claim 1, wherein the portion comprises a shape selected from the group consisting of: a circular shape, an oval shape, a rectangular shape, a square shape, a triangular shape, a quadrilateral shape, a pentagonal shape, a hexagonal shape, a heptagonal shape, an octagonal shape, a nonagonal shape, a decagonal shape, a tear-drop shape, and a crescent shape.

13. The neck cushioning device of claim 12, wherein the portion comprises the tear-drop shape.

14. The neck cushioning device of claim 12, wherein the shape is formed from material folded upon itself.

15. A neck cushioning device to prevent neck pain of a user while having their hair washed, the neck cushioning device comprising:

a unitary elongated piece as a body cushioning portion having a first side disposed opposite a second side and a first end disposed opposite a second end;

a neck cushioning portion extending from the first end of the body cushioning portion, the neck cushioning portion having a first side contiguous with the first side of the body cushioning portion and a second side contiguous with the second side of the body cushioning portion;

a flap component affixed to the neck cushioning portion, having a first side contiguous with the first side of the neck cushioning portion and a second side contiguous with the second side of the neck cushioning portion, wherein the flap component is received in a sink during use;

a first set of fasteners located on the first side of the flap component;

a second set of fastenes located on the second side of the body cushioning portion, configured to interact with the first set of fixation means to establish and maintain the neck cushioning device in a closed or stored position;

wherein the second side of the neck cushioning device rests on a horizontal surface, wherein the first side of the body cushioning portion is configured to receive a body of the user, wherein the first side of the neck cushioning portion is configured to receive a neck of the user, and wherein the first side of the flap in the sink is configured to receive the hair of the user.

16. The neck cushioning device of claim 15, further comprising an outer waterproof coating covering an inner material selected from the group consisting of: a flexible cushioning material, a gel-based material, and a foam material.

17. The neck cushioning device of claim 15, further comprising a handle component positioned on the second side of the body cushioning portion for carrying the neck cushioning device when in a closed or stored position.

18. The neck cushioning device of claim 15, further comprising a pouch disposed on the second side of the body cushioning portion configured to receive one or more objects therein for storage.

* * * * *